United States Patent [19]

Udagawa et al.

[11] Patent Number: 4,827,270

[45] Date of Patent: May 2, 1989

[54] ANTENNA DEVICE

[75] Inventors: Shigeo Udagawa; Tetsuo Haruyama; Nobutake Orime; Takashi Katagi, all of Kamakura, Japan

[73] Assignee: Mitsubishi Denki Kabushiki Kaisha, Tokyo, Japan

[21] Appl. No.: 130,646

[22] Filed: Dec. 9, 1987

[30] Foreign Application Priority Data

Dec. 22, 1986 [JP] Japan ..... 61-305851
Dec. 22, 1986 [JP] Japan ..... 61-305853
Jan. 14, 1987 [JP] Japan ..... 62-7309

[51] Int. Cl.[4] ..... H01Q 21/00

[52] U.S. Cl. ..... 343/853; 343/844; 342/373

[58] Field of Search ..... 343/853, 844, 858; 342/368, 372, 373

[56] References Cited

U.S. PATENT DOCUMENTS 3,267,472 8/1966 Fink ..... 342/368
3,594,811 7/1971 Pierrot .
3,611,401 10/1971 Connolly ..... 342/372
3,803,624 4/1974 Kinsey ..... 342/373
4,010,474 3/1977 Provencher ..... 342/373

FOREIGN PATENT DOCUMENTS 2455369 12/1980 France ..... 342/268
0230304 12/1984 Japan ..... 343/DIG. 2
957247 5/1964 United Kingdom .
2135828 9/1984 United Kingdom .

OTHER PUBLICATIONS

"Low-Angle Radar Tracking in the Presence of Multipath", by W. D. White, Published Nov. 1974, vol. AES-10, No. 6, IEEE.

*Primary Examiner*—William L. Sikes
*Assistant Examiner*—Hoanganh Le
*Attorney, Agent, or Firm*—Oblon, Fisher, Spivak, McClelland & Maier

[57] ABSTRACT

Antenna device for detecting a direction of an object lying in a low angle direction, which is constructed with a plurality of antenna elements, feeds, and so forth, and comprises a central feed for feeding RF signals to one or a plurality of central antenna elements, and a peripheral feed for feeding RF signals to a plurality of peripheral antenna elements, and that one of input terminals of the central feed and one of input terminals of the peripheral feed are connected together by a hybrid circuit.

4 Claims, 11 Drawing Sheets

ANTENNA DEVICE

BACKGROUND OF THE INVENTION

1. Field of the Invention

This invention relates to an antenna device for detecting a direction of an object which lies in a low angle direction.

2. Description of the Background

As the system for detecting a direction of an object lying in a low angle direction, there has already been known the "fixed beam system" as disclosed in the following literature: "Low-Angle Radar Tracking in the Presence of Multipath" by W. D. White, IEEE Transactions, Aerospace and Electronic Systems, Vol. AES-10, pp. 835–852, November 1974.

In the following, explanations will be given as to the fixed beam system in accordance with the above-quoted literature.

FIG. 9 of the accompanying drawings is an explanatory diagram indicating a positional relationship between the antenna device and an object to be detected. In the diagram, a reference numeral 1 designates the antenna device, a numeral 2 refers to the object to be detected, a reference numeral 3 denotes the surface of water, a numeral 4 represents a mirror image of the object 2 formed by the surface of water 3, a reference numeral 5 denotes a propagation path of a direct wave, and a numeral 6 refers to a propagation path of a reflected wave.

Assuming that the antenna device 1 is capable of forming two kinds of radiation beams in different shapes, that is: beam $F_A$ and beam $F_B$, they satisfy the summetry condition as represented by the following equation (1) in respect of an arbitrary angle u.

$$\frac{F_B(u)}{F_A(u)} = \frac{F_B(-u)}{F_A(-u)} \tag{1}$$

Further assuming that the axis of the antenna device 1 is oriented in the bisector angle of the object 2 and the mirror image 4, a received voltage $V_A$ due to the beam $F_A$ can be represented by the following equation (2):

$$V_A = E_S\{F_A(u) + \rho e^{j\phi}F_A(-u)\} \tag{2}$$

(where:

Es denotes amplitude of the direct wave;

u represents an incident angle of the direct wave into the antenna device 1;

−u represents an incident angle of a reflected wave into the antenna device 1;

$\rho$ denotes a voltage reflection coefficient of the surface of water; and $\phi$ indicates a phase difference between the direct wave and the reflected wave).

Similarly, a received voltage $V_B$ due to the beam $F_B$ can be represented by the following equation (3):

$$V_B = E_S\{F_B(u) + \rho e^{j\phi}F_B(-u)\} \tag{3}$$

Taking a ratio between $V_B$ and $V_A$, it may be represented as follows:

$$\frac{V_B}{V_A} = \frac{F_B(u) + \rho e^{j\phi}F_B(-u)}{F_A(u) + \rho e^{j\phi}F_A(-u)} = \frac{F_B(u)}{F_A(u)} \cdot \frac{\{1 + \rho e^{j\phi}F_B(-u)/F_B(u)\}}{\{1 + \rho e^{j\phi}F_A(-u)/F_A(u)\}} \tag{4}$$

The above equation (4) may be arranged by substituting the symmetry condition in the equation (1) to be as follows:

$$\frac{V_B}{V_A} = \frac{F_B(u)}{F_A(u)} \tag{5}$$

As the consequence of this, by the measurement of the voltage ratio $V_B/V_A$, it becomes possible to find out an accurate direction u of the object 2 by use of a known function $F_B/F_A$, without having regard to existence of the reflected wave.

As described in the preceding, the fixed beam system is effective as to detecting the direction of an object lying in the low angle direction, while it has a point of problem such that the method of constructing the antenna device satisfying the symmetry condition of the above equation (1) was not known.

SUMMARY OF THE INVENTION

The present invention has been made with a view to solving the above-mentioned point of problem, and aims at clarifying the concrete construction of such antenna device that meets the symmetry condition of the equation (1) and providing thereby the antenna device, in which the fixed beam system can be practically adopted.

According to the present invention, there is provided an antenna device constructed with a plurality of antenna elements, feeds, and others, the antenna device being characterized in that it comprises a central feed for feeding RF signals to one or a plurality of antenna elements disposed at the central part thereof, and a peripheral feed for feeding RF signals to a plurality of antenna elements disposed at the peripheral part thereof, and that one of input terminals of the central feed and one of input terminals of the peripheral feed are connected by way of a hybrid circuit.

Various ways of carrying out the invention is described in detail hereinbelow with reference to the drawings which illustrate several preferred embodiments, in which

BRIEF DESCRIPTION OF THE DRAWINGS

FIG. 1*d* and 1*e* are explanatory diagrams showing a construction of a quarter-wave coupled-line directional coupler, wherein FIG. 1*e* is a side view of the coupler, and FIG. 1*d* is a plan view taken along a line F—F in FIG. 1*e;*

DESCRIPTION OF THE PREFERRED EMBODIMENT

In the following, the present invention will be explained in detail with reference to the first embodiment thereof.

Figure 1A:
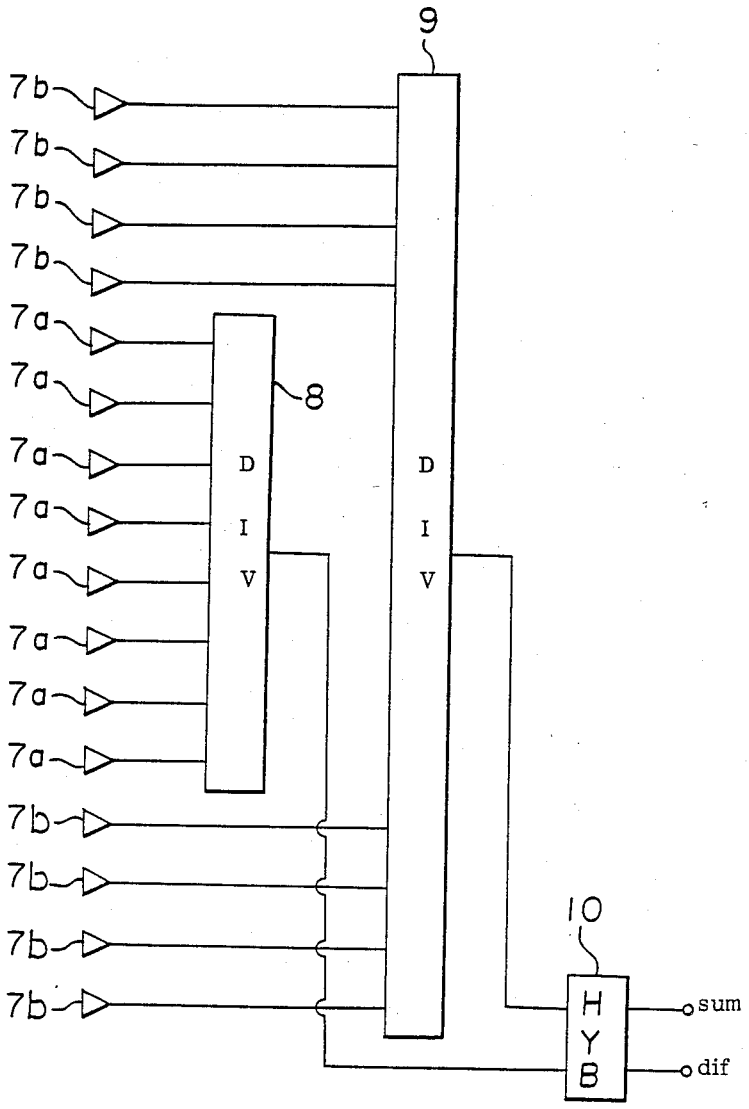
FIG. 1*a* is a schematic diagram showing a construction of the antenna device according to the first embodiment of the present invention.

In FIG. 1*a*, a reference numeral 7*a* designates antenna elements at the central part of the antenna device, a numeral 7*b* refers to antenna elements at the peripheral part of the antenna device, a reference numeral 8 denotes a central feed constructed with a power divider to feed RF signals to the central antenna elements 7*a*, a numeral 9 refers to a peripheral feed constructed with a power divider to feed RF signals to the peripheral antenna elements 7*b*, and a numeral 10 refers to a hybrid circuit for connecting an input terminal of the central feed 8 and an input terminal of the peripheral feed 9.

Figure 1B:
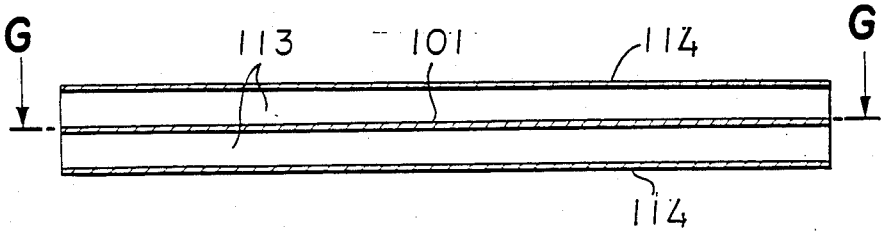
FIG. 1*b* is a side view showing one concrete embodiment of the hybrid circuit.
Figure 1C:
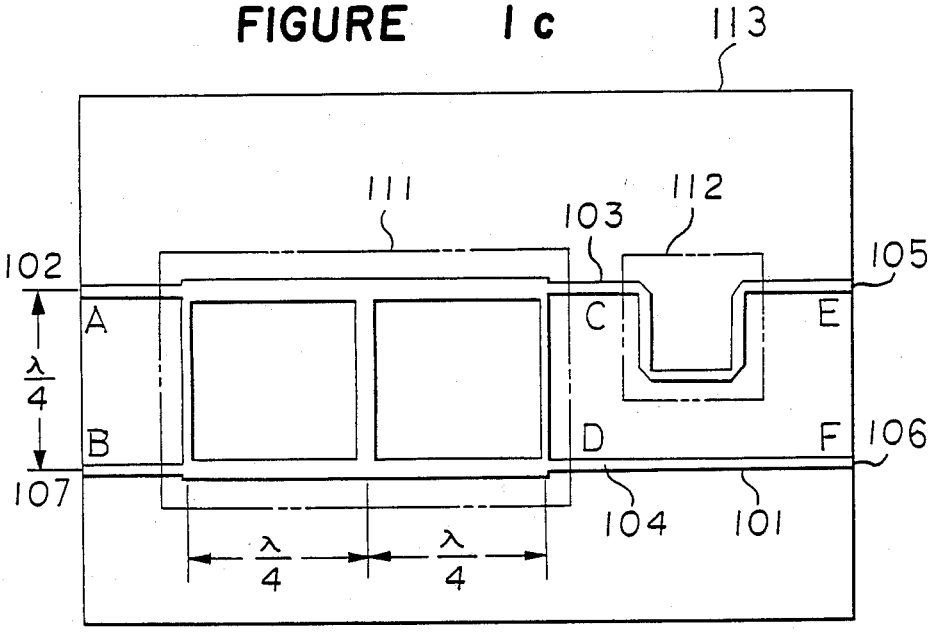
FIG. 1*c* is a plan view taken along a line G—G in FIG. 1*b;*

FIGS. 1*b* and 1*c* illustrates one example of construction of the hybrid circuit 10 which is composed of a three-arm branch hybrid 111 and a 90°-phase delay line 112 by use of strip lines.

When a radio frequency input signal is introduced into an A-terminal 102 of the hybrid circuit in FIG. 1*c*, the input signal is divided, with an equal amplitude, to a C-point 103 and a D-point 104. The phase relationship is such that the point C advances by 90 degrees with respect to the point D. This phase advancement is corrected by the phase delay line 112, whereby a signal having equal amplitude and equal phase is obtained at each of E-terminal 105 and F-terminal 106.

In the next place, when a radio frequency input signal is introduced into a B-terminal 107, the input signal is divided, with an equal amplitude, to the point C and the point D, in which the phase relationship is such that the C-point 103 is delayed by 90 degrees with respect to the D-point 104. This delay in the phase further brings about a delay of 180 degrees after the signal will have passed through the phase delay line 112, with the consequence that the signal having an equal amplitude and an opposite phase appears at each of the E-terminal 105 and the F-terminal 106. By the way the construction of the hybrid circuit is not limited to that as shown in FIGS. 1*b* and 1*c*, but it may be a "rat-race" circuit, and so forth. In FIGS. 1*b* and 1*c*, a reference numeral 113 designates a dielectric substrate, a numeral 114 refers to a grounding conductor, and λ denotes signal wavelength.

In the following, explanations will be made as to a quarter-wave coupled-line directional coupler, which is the fundamental element for construction of the power divider.

Figure 1D:
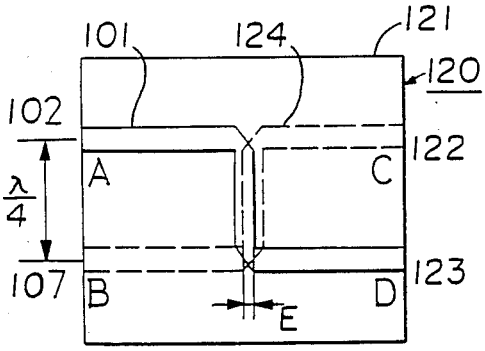
Figure 1E:
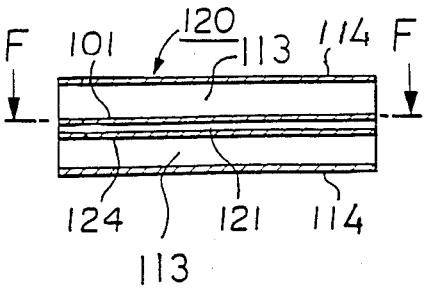

FIG. 1*e* is a side view showing a construction of the quarter-wave coupled-line directional coupler 120 using strip lines, and FIG. 1*d* is a plan view showing the shape of the line conductor provided on both surfaces of the dielectric substrate 121 constituting the inner layer.

When a radio frequency input signal is introduced into the A-terminal 102 in FIG. 1*d*, the signal is divided to each of the C-terminal 122 and the D-terminal 123. The power ratio in this instance is mainly determined by an overlapping dimension E between the front line conductor 101 and the rear line conductor 124. A desired power ratio can be obtained by appropriate selection of this overlapping dimension E. The phase relationship is such that the C-terminal 122 advances by 90 degrees with respect to the D-terminal 123. Incidentally, no output signal comes out to the B-terminal 107.

In the following, explanations will be given as to the power divider for use in the present invention.

Figure 1F:
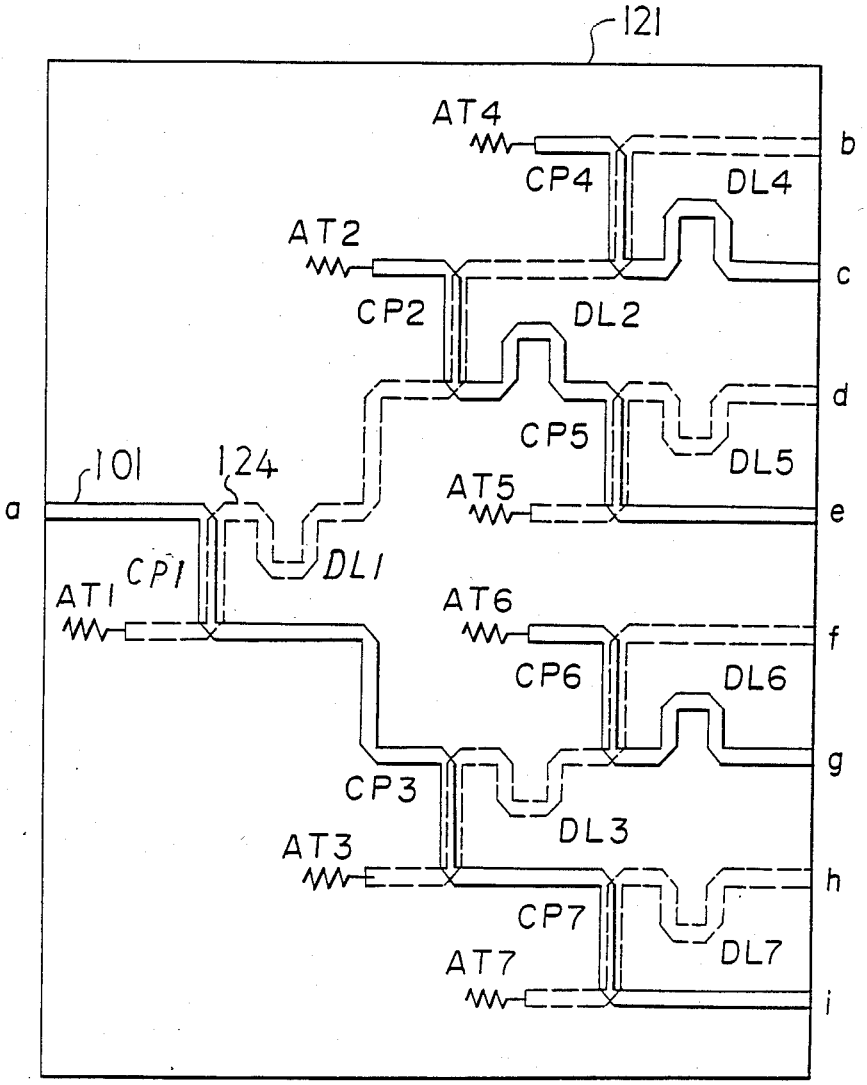
FIG. 1*f* is a plan view showing one concrete embodiment of the power divider.

FIG. 1*f* is a plan view showing an example of construction of an 8-way power divider, in which the above-mentioned quarter-wave coupled-line directional couplers are connected in multi-stages. A radio frequency input signal introduced into the a-terminal in FIG. 1*f* is sequentially divided by means of the quarter-wave coupled-line directional couplers CP1 through CP7, and output signals are obtained at the output terminals b through i. A predetermined power ratio such as Taylor distribution, etc. may be obtained by appropriate selection of the overlapping dimensions of the quarter-wave coupled-line directional couplers. As regards the signal phase, since the above-mentioned 90°-phase advancement is corrected by DL1 to DL7, the output signal is obtained with an equal phase. In the drawing, $AT_1$ to $AT_7$ refer to matched terminations, and DL1 to DL7 denote the 90°-phase delay lines It should be noted that, while FIG. 1*f* indicates an example of using the quarter-wave coupled-line directional couplers as the dividing elements, the invention is not limited to this example alone, and there may be employed a Wilkinson type coupler, etc.. Further, the number of output terminals is not limited to eight (8), but any numbers required for feeding the antenna elements may be obtained by appropriate selection of the number of connecting stages of the dividing elements.

In the following, explanations will be given as to the operations of the antenna device according to the first embodiment of the present invention when it is used in the signal transmission mode.

Figure 2A:
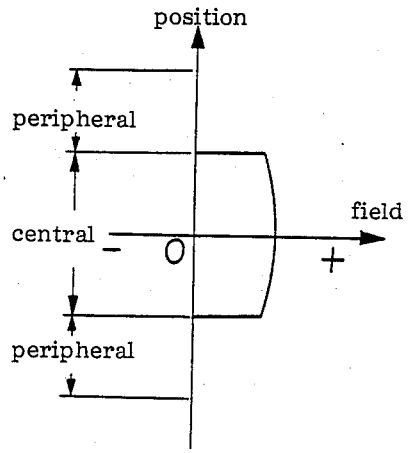
FIG. 2*a* is an explanatory diagram showing an aperture distribution, when an input signal is introduced into the central feed to be used for the antenna device according to the present invention.
Figure 2C:
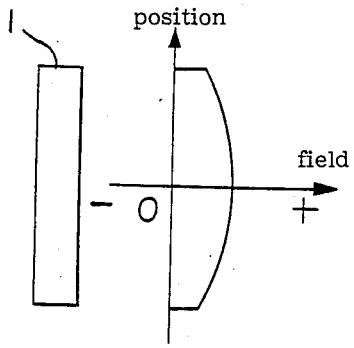
FIG. 2*c* is an explanatory diagram showing an aperture distribution to be obtained when a radio frequency input signal is introduced into a sum signal terminal of the hybrid circuit shown in FIG. 1*a* to be used for the antenna device according to the present invention.
Figure 2B:
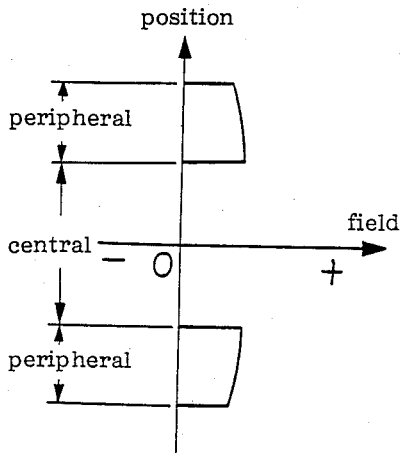
FIG. 2*b* is an explanatory diagram showing an aperture distribution, when an input signal is introduced into the peripheral feed.

When a radio frequency input signal is introduced into the sum signal terminal (corresponding to the A-terminal 102 in FIG. 1*c*) of the hybrid circuit 10, this radio frequency signal is divided with the same phase depending on the nature of the hybrid circuit, as mentioned in the foregoing, whereby the radio frequency signal of the same phase is supplied to the central feed 8 and the peripheral feed 9. Both central feed 8 and peripheral feed 9 carry out predetermined distribution to the central antenna elements 7*a* and the peripheral antenna elements 7*b*, respectively. In other words, when the radio frequency input signal is introduced into the central feed 8 alone, its aperture distribution will appear in the form as shown in FIG. 2*a*. On the other hand, when the input signal is introduced into the peripheral feed 9 alone, its aperture distribution appears in the form as shown in FIG. 2*b*.

Here, if the radio frequency input signal is introduced into the sum signal terminal of the hybrid circuit 10, there will be supplied a signal of equal amplitude and equal phase into both central feed 8 and peripheral feed 9. As the consequence of this, the aperture distribution thereof will be the sum of the distributions shown in FIGS. 2*a* and 2*b*, whereby a distribution as shown in FIG. 2*c* is obtained.

Figure 2D:
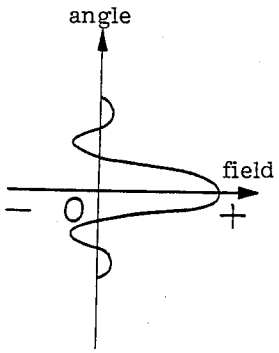
FIG. 2*d* illustrates a radiation pattern of the antenna device to be obtained under the conditions shown in FIG. 2*c;*

Since this aperture distribution represents a state, in which the central antenna elements 7*a* and the peripheral antenna elements 7*b* are all excited with the equal phase, there will be obtained a symmetrical radiation pattern in its up-and-down direction and having the maximum value in the frontward direction of the antenna device 1 as shown in FIG. 2*d*.

Figure 3A:
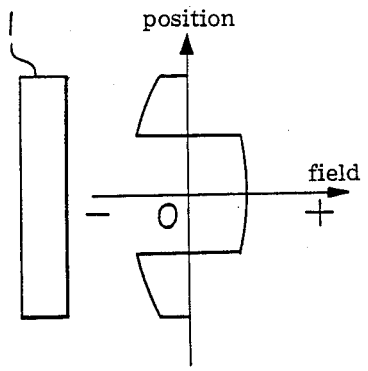
FIG. 3*a* is an explanatory diagram showing an aperture distribution to be obtained when a radio frequency input signal is introduced into a differential signal terminal of the hybrid circuit shown in FIG. 1*a* to be used for the antenna device according to the present invention.
Figure 3B:
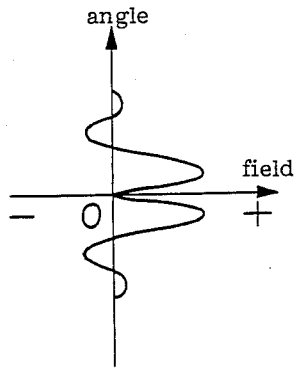
FIG. 3*b* indicates a radiation pattern of the antenna device to be obtained under the conditions of FIG. 3*a;*

When a radio frequency input signal is introduced into the differential signal terminal (corresponding to the B-terminal 107 in FIG. 1*c*) of the hybrid circuit 10, this radio frequency signal is divided with an opposite phase, depending on the nature of the hybrid circuit, whereby the radio frequency signal in the opposite phase is supplied to the central feed 8 and the peripheral feed 9. Both central feed 8 and the peripheral feed 9 effect the predetermined distribution to the central antenna elements 7*a* and the peripheral antenna elements 7*b*, respectively. The aperture distribution in this case appears as a distribution resulting from reduction of the distribution in FIG. 2*b* from that in FIG. 2*a* with the consequent distribution as shown in FIG. 3*a*. Since this aperture distribution is in such a state that the peripheral antenna elements 7*b* are excited with the opposite phase with respect to the central antenna elements 7*a*, there is obtained a radiation pattern which is symmetrical in the up-and-down direction and has the minimum value in the frontward direction of the antenna device 1 as shown in FIG. 3*b*.

So far the explanations have been given as to the operations of the antenna device when it is used in the signal transmission mode. Since a reciprocity theorem can be generally established for both signal transmission characteristics and signal receiving characteristics of the antenna, the same radiation pattern as described above is also obtained, even when the antenna device is used in its signal receiving mode. That is to say, the receiving pattern to be obtained at the sum signal terminal of the hybrid ciucuit 10 is the same as that of FIG. 2*d*, while the receiving pattern to be obtained at the differential signal terminal of the hybrid circuit 10 is the same as that of FIG. 3*b*.

As the consequence of this, in the signal receiving mode, the symmetry condition of the equation (1) can be satisfied by use of the sum signal to be obtained from the hybrid circuit as the beam $F_A$ in the equation (1) and the differential signal as the beam $F_B$ of the equation (1), whereby the direction of an object lying in a low angle direction can be detected by utilization of the fixed beam system.

Figure 4:
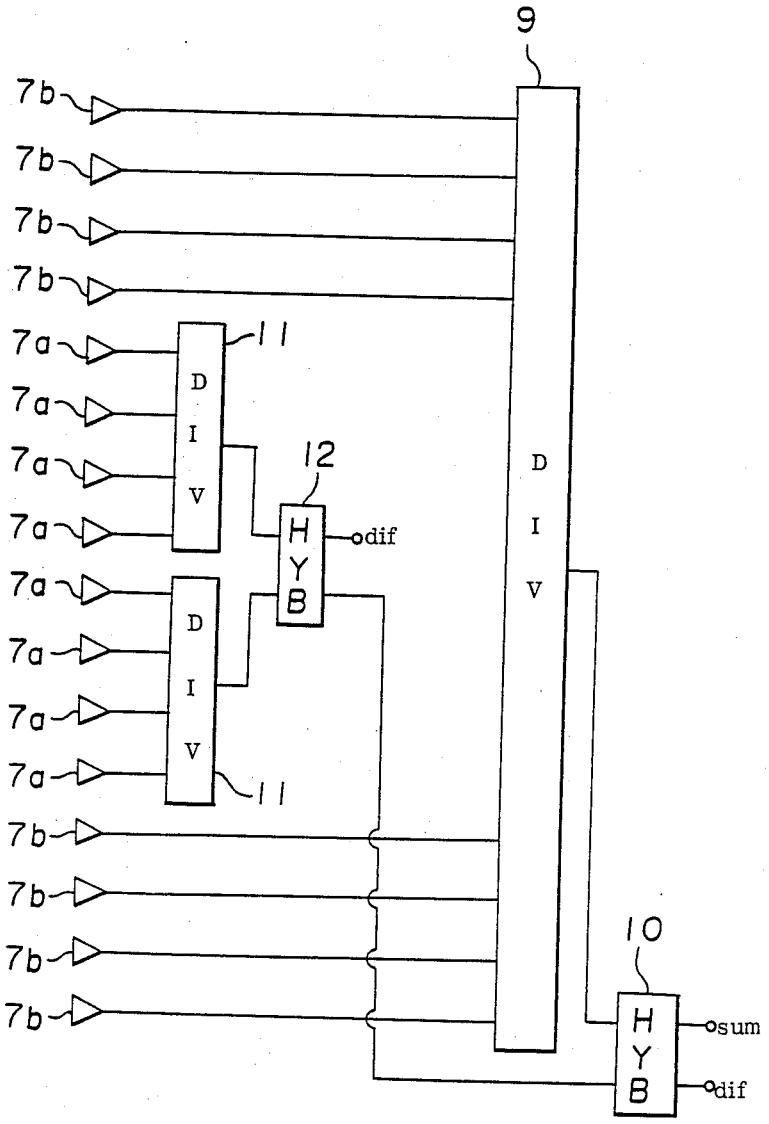
FIG. 4 is a schematic diagram of the antenna device according to the second embodiment of the present invention.

By the way, it should be understood that, while, in the above-described first embodiment of the antenna device according to the present invention, the central feed 8 is constructed with the power divider alone, it may, of course, be constructed with a plurality of power dividers 11 and one or a plurality of hybrid circuits 12 as shown in FIG. 4. In the second embodiment of FIG. 4, the fixed beam system can be adopted in the same manner as in the above-described first embodiment, in addition to which there can be carried out the angle measurement by the mono-pulse system utilizing the differential signal from the hybrid circuit 12.

As has so far been described in the foregoing, the antenna device according to the embodiment of the present invention is constructed by dividing the antenna elements and the feeds into the central part and the peripheral part thereof, and then one of the input terminals of the central feed and one of the input terminals of the peripheral feed are connected together by means of the hybrid circuit, it can satisfy the symmetry condition of the radiation beam which is indispensable for adopting the fixed beam system, whereby the antenna device capable of detecting the direction of an object lying in the low angle direction can be effectively obtained.

In the next place, explanations will be given as to the third embodiment of the antenna device according to the present invention.

Figure 5:
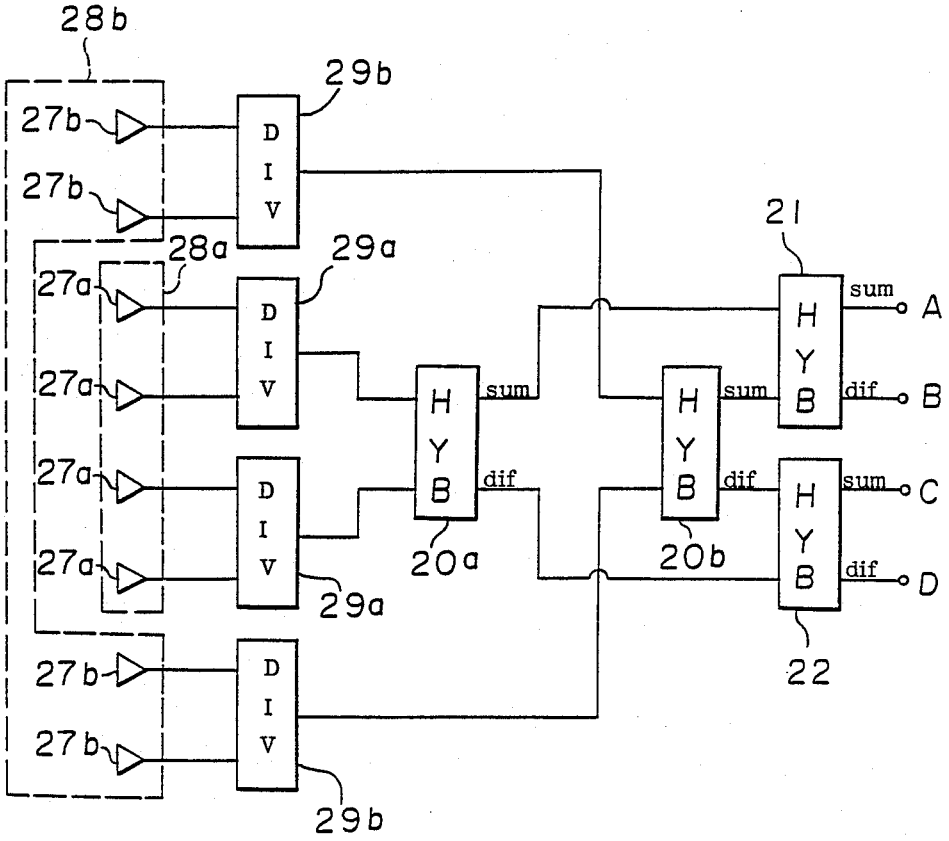
FIG. 5 is a schematic diagram of the antenna device according to the third embodiment of the present invention.

In FIG. 5, a reference numeral 27*a* designates a plurality of central antenna elements, a numeral 27*b* refers to a plurality of peripheral antenna elements, 28*a* denotes a first sub-array antenna constructed by the central antenna elements 27*a*, a numeral 28*b* refers to a second sub-array antenna constructed by the peripheral antenna elements 27*b*, a numeral 29*a* refers to a plurality of central power dividers for feeding RF signals to the central antenna elements 27*a*, a reference numeral 29*b* designates a plurality of peripheral power dividers for feeding RF signals to the peripheral antenna elements 27*b*, a numeral 20*a* refers to a first hybrid circuit for connecting the central power dividers 29*a*, a reference numeral 20*b* denotes a second hybrid circuit for connecting the peripheral power dividers 29*b*, a reference numeral 21 represents a third hybrid circuit for connecting the sum signal terminal of the first hybrid circuit 20*a* and the sum signal terminal of the second hybrid circuit 20*b*, and a numeral 22 refers to a fourth hybrid circuit for connecting the differential signal terminal of the first hybrid circuit 20*a* and the differential signal terminal of the second hybrid circuit 20*b*.

In the following, explanations will be given as to the operations of the antenna device according to the third embodiment of the present invention in its signal transmission mode.

It is to be noted that a plurality of the central and peripheral antenna elements, a plurality of the central and peripheral power dividers, and the first to third hybrid circuits to be used in this third embodiment have the same functions as those used in the first and second embodiments.

When the radio frequency input signal is introduced into the terminal A shown in FIG. 5, it is divided by the first to third hybrid circuits 20*a*, 20*b* and 21 with the same phase, whereby the radio frequency signals of the same phase are supplied to the central and peripheral power dividers 29*a* and 29*b*. The central power divider 29*a* and the peripheral power divider 29*b* perform the predetermined distribution to the central antenna elements 27*a* and the peripheral antenna elements 27*b* with the result that the aperture distribution as shown in FIG. 2*c* and the radiation pattern same as that shown in FIG. 2*d* are obtained.

When the radio frequency input signal is introduced into the terminal B shown in FIG. 5, it is divided by the first to third hybrid circuits with the result that the aperture distribution as shown in FIG. 3*a* and the radiation pattern same as that shown in FIG. 3*b* are obtained.

Figure 6A:
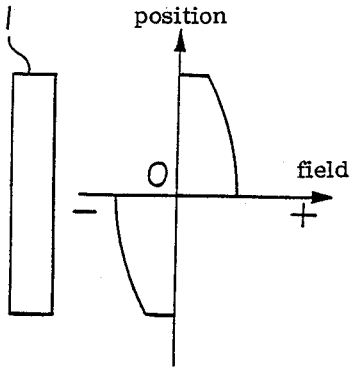
FIG. 6*a* is an explanatory diagram showing an aperture distribution to be obtained when a radio frequency input signal is introduced into a C-signal terminal of a fourth hybrid circuit shown in FIG. 5.
Figure 6B:
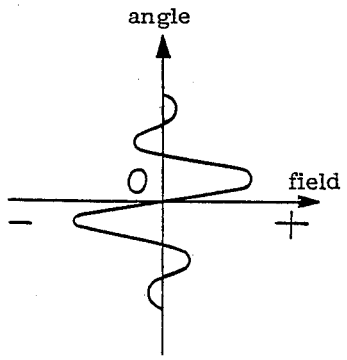
FIG. 6*b* indicates a radiation pattern of the antenna device to be obtained under the conditions shown in FIG. 6*a;*

When the radio frequency input signal is introduced into the terminal C shown in FIG. 5, it is divided by the first, second and fourth hybrid circuits, and then supplied to the central power dividers 29*a* and the peripheral power dividers 29*b*. The aperture distribution in this instance is in a state as shown in FIG. 6*a*, wherein the upper half and the lower half of the antenna device 1 is excited with the opposite phase, and the radiation pattern as shown in FIG. 6*b*, having a zero point in the frontward direction of the antenna device 1, is obtained.

So far the explanations have been given as to the operations of the antenna device when it is used in the signal transmission mode. Since a reciprocity theorem can be generally established, for both signal transmission characteristics and signal receiving characteristics of the antenna, the same radiation pattern as described above is also obtained, even when the antenna device is used in its signal receiving mode. That is to say, the receiving pattern to be obtained at the terminal A in FIG. 5 is the same as that shown in FIG. 2*d*, the receiving pattern to be obtained at the terminal B is the same as that shown in FIG. 3*b*, and the receiving pattern to be obtained at the terminal C is the same as that shown in FIG. 6*b*.

As the consequence of this, in the signal receiving mode, the symmetry condition of the equation (1) can be satisfied by use of the signal to be obtained from the terminal A as the beam $F_A$ of the above-mentioned equation (1) and the signal to be obtained from the terminal B as the beam $F_B$ of the equation (1), whereby the direction of an object lying in a low angle direction can be detected by utilization of the fixed beam system.

Further, there may also be carried out the angle measurement by means of the mono-pulse system in utilization of the phenomenon, in which the signal receiving pattern to be obtained from the terminal C is identical with the differential pattern in the ordinary mono-pulse system.

Figure 7:
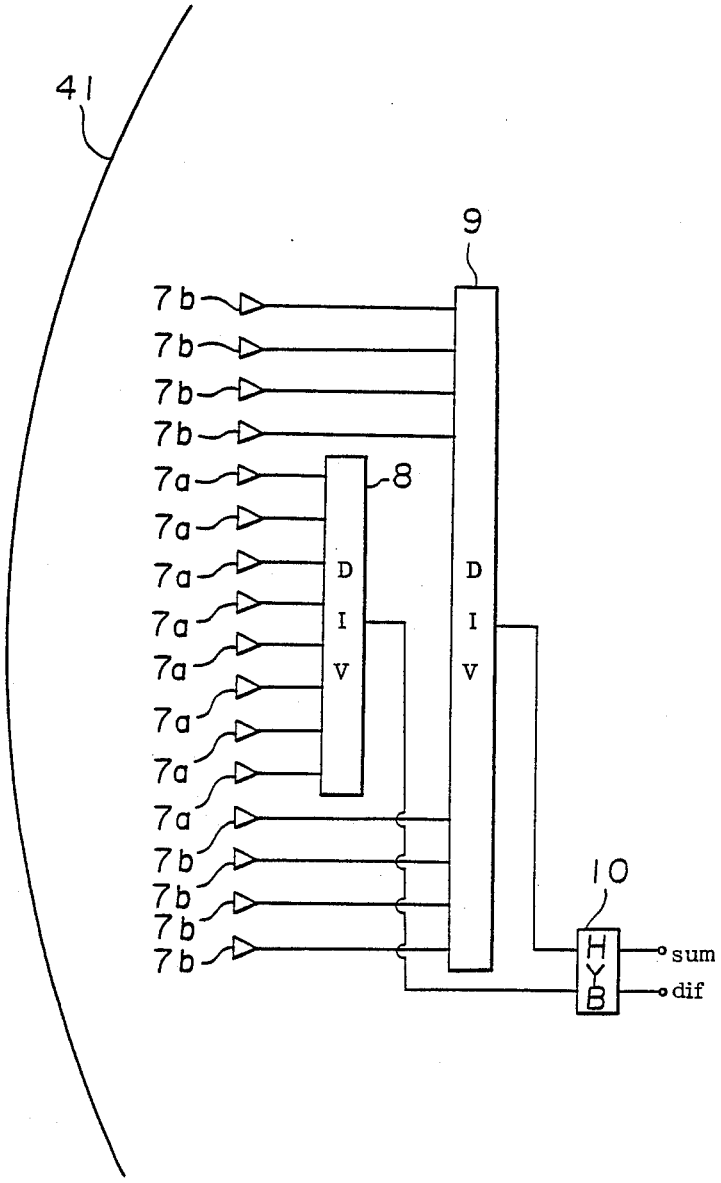
FIG. 7 is a schematic diagram of the antenna device according to the fourth embodiment of the present invention.

FIG. 7 illustrates the antenna device in accordance with the fourth embodiment of the present invention. This fourth embodiment is identical with the first embodiment with the exception that one or a plurality of reflectors 41 are provided. Therefore, the same parts used in both embodiments are designated by the same reference numerals. Accordingly, the antenna device also possesses the same functions and resulting effect as those of the first embodiment.

Figure 8:
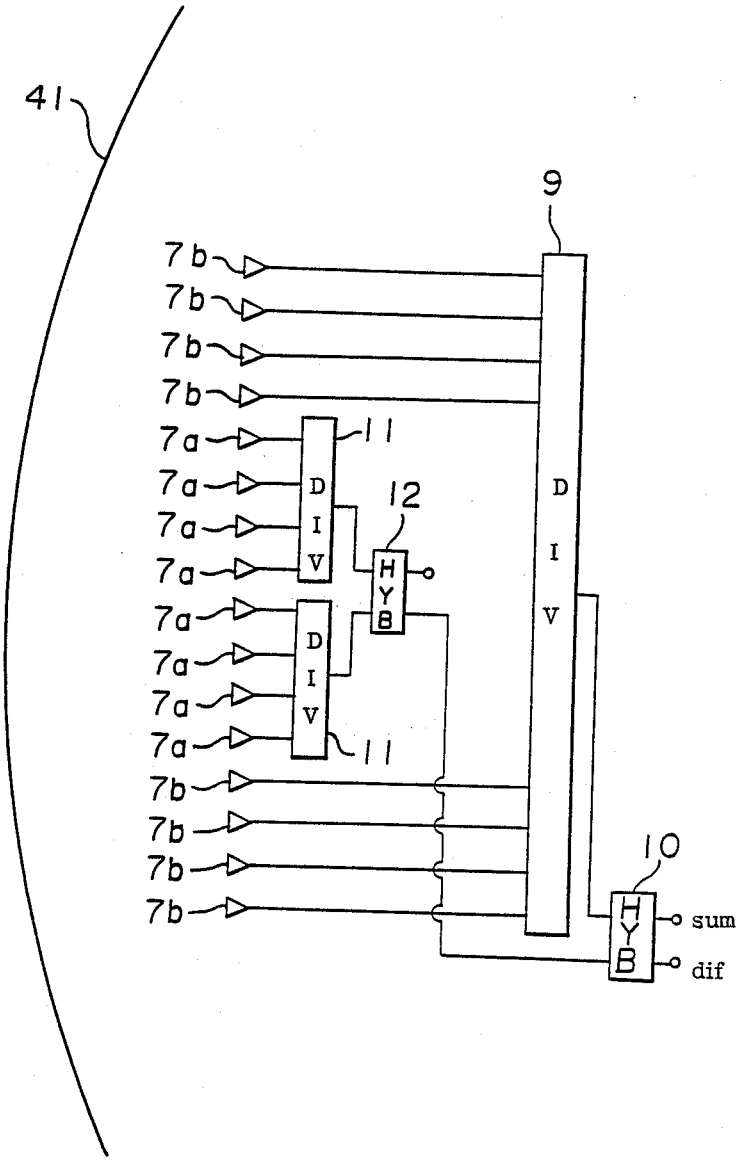
FIG. 8 is a schematic diagram of the antenna device according to the fifth embodiment of the present invention.
Figure 9:
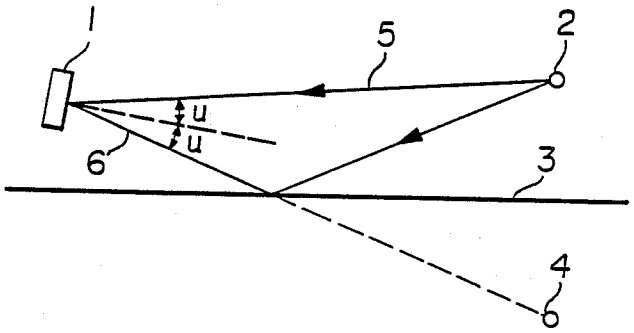
FIG. 9 is an explanatory diagram showing a positional relationship between the antenna device and an object to be detected.

FIG. 8 illustrates the antenna device in accordance with the fifth embodiment of the present invention. This fifth embodiment is also identical with the second embodiment shown in FIG. 4 with the exception that one or a plurality of reflectors 41 are provided. Accordingly, the antenna device possesses the same functions and resulting effect as those of the second embodiment. On account of such identity between the two embodiments, the same parts in these embodiments are designated by the same reference numerals, and explanation of each of them are dispensed with.

In the above-mentioned first and fourth embodiments of the present invention, the peripheral feed 9 is shown to be constructed with the power dividers alone. It should, however, be understood that the peripheral feed 9 may be constructed with a plurality of power dividers and one or a plurality of hybrid circuits, which also produces the same effect as in the second and fifth embodiments.

Moreover, in the above-mentioned embodiments, explanations have been given as to the case wherein the reflected wave is produced from the water surface. It should, however, be noted that the present invention is not limited to this mode alone, but the same resulting effect as in this mode can be obtained with respect to the reflected wave due to the ground, buildings or various other structures.

The foregoing explanations are with respect to the antenna device using no phase shifters, and the same resulting effect as in the foregoing embodiments can be obtained as to the antenna device of a construction, in which phase shifters are connected between the antenna elements and the feeds so as to be capable of performing the electronic beam scanning.

We claim:

1. Antenna device for detecting a direction of an object which lies at a low angle direction and has a reflected wave from a surface, constructed with a plurality of antenna elements and a plurality of feeds, said antenna device comprising:

a central feed for feeding RF signals to at least one of a plurality of central antenna elements;

a peripheral feed for feeding RF signals to a plurality of peripheral antenna elements;

one of input terminals of said central feed and one of input terminals of said peripheral feed being connected together by a hybrid circuit;

a plurality of antenna elements at the central part of the antenna device being divided into a plurality of groups of antenna elements;

said central feed being constructed with a first plurality of power dividers for feeding RF signals to each of said groups of antenna elements;

a first hybrid circuit which connects each of said first power dividers;

a plurality of antenna elements at the peripheral part of the antenna device being divided into a plurality of groups of antenna elements;

said peripheral feed being constructed with a second plurality of power dividers for feeding RF signals to each of said groups of antenna elements;

a second hybrid circuit for connecting each of said second power dividers;

each input terminal of said first hybrid circuit and each input terminal of said second hybrid circuit being connected by way of a third and a fourth hybrid circuits;

wherein by measuring the ratio of the signal from the central antenna elements to the signal from the peripheral antenna elements, the direction of the object is determined without regard to the existence of the reflected wave.

2. Antenna device for detecting a direction of an object which lies at a low angle direction and has a reflected wave from a surface, constructed with a plurality of antenna elements, and a plurality of feeds, said antenna device comprising:

a central feed for feeding RF signals to at least one of a plurality of central antenna elements;

a peripheral feed for feeding RF signals to a plurality of peripheral antenna elements;

one of input terminals of said central feed and one of input terminals of said peripheral feed being connected together by a hybrid circuit;

wherein said antenna includes a primary radiator in cooperation with at least one reflector;

wherein by measuring the ratio of the signal from the central antenna elements to the signal from the peripheral antenna elements, the direction of the object is determined without regard to the existence of the reflected wave.

3. Antenna device as set forth in claim 2, characterized in that the central part of said primary radiator is divided into a plurality of groups of antenna elements, and that said central feed is constructed with a plurality of power dividers for feeding RF signals to each of said groups of the antenna elements and a hybrid circuit for connecting each of said power dividers.

4. Antenna device as set forth in claim 2, characterized in that the peripheral part of said primary radiator is divided into a plurality of groups of antenna elements, and that said peripheral feed is constructed with a plurality of power dividers for feeding RF signals to each of said groups of antenna elements and a hybrid circuit for connecting each of said power dividers.

* * * * *